US008955282B2

(12) United States Patent
Yap Ching

(10) Patent No.: US 8,955,282 B2
(45) Date of Patent: Feb. 17, 2015

(54) SOLOARMAR CONSTRUCTION ENGINEERING SYSTEM

(76) Inventor: Mixza Yap Ching, Panama (PA)

( * ) Notice: Subject to any disclaimer, the term of this patent is extended or adjusted under 35 U.S.C. 154(b) by 2029 days.

(21) Appl. No.: 11/912,303

(22) PCT Filed: Apr. 21, 2006

(86) PCT No.: PCT/CR2006/000004

§ 371 (c)(1),
(2), (4) Date: Dec. 19, 2011

(87) PCT Pub. No.: WO2006/111106

PCT Pub. Date: Oct. 26, 2006

(65) Prior Publication Data

US 2012/0102863 A1 May 3, 2012

(30) Foreign Application Priority Data

Apr. 21, 2005 (PA) ..... 86310-01

(51) Int. Cl.

| | |
|---|---|
| ***E04B 1/686*** | (2006.01) |
| ***E04B 1/02*** | (2006.01) |
| ***E04B 2/00*** | (2006.01) |
| ***E04B 5/04*** | (2006.01) |

(Continued)

(52) U.S. Cl.

CPC ... *E04B 2/16* (2013.01); *E04B 2/24* (2013.01); *E04B 2002/0245* (2013.01)

USPC ..... 52/585.1; 52/562; 52/396.06; 52/606

(58) Field of Classification Search

CPC ..... E04B 2/16; E04B 2002/0245; E04B 2002/0243

USPC ..... 52/562, 564, 513, 606, 604, 585.1, 52/396.08, 396.09

See application file for complete search history.

(56) References Cited

U.S. PATENT DOCUMENTS

| | | | | |
|---|---|---|---|---|
| 599,864 | A * | 3/1898 | Rapp | 52/585.1 |
| 919,272 | A * | 4/1909 | White | 52/592.1 |

(Continued)

FOREIGN PATENT DOCUMENTS

| | | | |
|---|---|---|---|
| CA | 1258592 | A | 8/1989 |
| JP | 8-135044 | A | 5/1996 |
| JP | 2000-234405 | A | 8/2000 |

OTHER PUBLICATIONS

International Preliminary Report on Patentability (Form PCT/IB/373) of International Application No. PCT/CR2006/000004 dated Jan. 29, 2008, with Form PCT/ISA/237.

(Continued)

*Primary Examiner* — Ryan Kwiecinski

(74) *Attorney, Agent, or Firm* — Westerman, Hattori, Daniels & Adrian, LLP

(57) ABSTRACT

The invention relates to the Soloarmar construction system comprising an original wall construction method, in which the cavities in the blocks are precisely aligned in the vertical axis. According to the invention, the blocks are assembled using an inner engagement device such that resistant masonry can be produced quickly and specially adapted for clay or concrete blocks using specific industrial templates, machines, nozzles and dies designed by Soloarmar. The appearance and characteristics obtained are similar to those obtained with standard masonry techniques, but with the mixture only being used to lay the first course instead of between all of the blocks.

6 Claims, 18 Drawing Sheets

(51) Int. Cl.

| | |
|---|---|
| ***E04B 2/16*** | (2006.01) |
| ***E04B 2/24*** | (2006.01) |
| *E04B 2/02* | (2006.01) |

(56) References Cited

U.S. PATENT DOCUMENTS

| | | | | | |
|---|---|---|---|---|---|
| 2,235,646 | A | * | 3/1941 | Schaffer | 52/585.1 |
| 2,243,339 | A | * | 5/1941 | Henzel et al. | 52/479 |
| 3,609,926 | A | * | 10/1971 | Muse | 52/439 |
| 3,966,339 | A | * | 6/1976 | Nemecek et al. | 403/292 |
| 4,110,949 | A | * | 9/1978 | Cambiuzzi et al. | 52/437 |
| 4,454,699 | A | * | 6/1984 | Strobl | 52/585.1 |
| 5,252,017 | A | * | 10/1993 | Hodel | 411/446 |
| 5,771,650 | A | * | 6/1998 | Williams et al. | 52/568 |
| 5,802,792 | A | * | 9/1998 | Fielding et al. | 52/396.09 |
| 5,921,046 | A | * | 7/1999 | Hammond, Jr. | 52/564 |
| 6,000,186 | A | | 12/1999 | Fielding et al. | |
| 6,691,485 | B1 | | 2/2004 | Prokofyev | |
| 6,857,240 | B1 | * | 2/2005 | MacAlister | 52/564 |
| 6,996,945 | B2 | * | 2/2006 | Doty | 52/585.1 |
| 7,328,535 | B1 | * | 2/2008 | Correia | 52/285.1 |

OTHER PUBLICATIONS

International Search Report of PCT/CR2006/000004, date of mailing date Oct. 23, 2006, with Written Opinion.

* cited by examiner

SOLOARMAR CONSTRUCTION ENGINEERING SYSTEM

BACKGROUND

In a traditional method of building masonry walls, a mortar mix has been commonly used to hold blocks together horizontally as well as vertically. The mix of sand and cement resists compression but does not resist lateral impact.

BRIEF SUMMARY OF THE INVENTION

With the proposed method, which is based on the modular dimensioning of the blocks, a continuity of vertical holes in the blocks is achieved for both sand with cement, as well as clay. A specially designed device (called "connector") is proposed for assembling one block with another and achieve such continuity of the holes in the blocks, in such a manner that the building of masonry walls is done in a dry mode, that is with no mortar mix needed for holding the blocks together, providing the following advantages:

- Savings in manpower, as skilled labor is not needed except for a bricklayer to install the first row.
- Savings in materials, with less waste since a mortar mix is not used between blocks.
- Time savings in the building of walls, which can be assembled much more rapidly, by positioning the blocks with no need for leveling and no use of mortar mix.
- Time savings in the finishing of walls with mortar which is applied to the vertical surfaces of the blocks only to seal the blocks.
- Savings in that plastic materials which are non-biodegradable are recycled to make the connectors used to hold the blocks together, thus lessening the impact on the environment.
- Savings in the amount of mortar mix (sand and cement), reducing the indiscriminate extraction of sand from the littoral or beaches.

DESCRIPTION OF THE INVENTION

Figure 1:
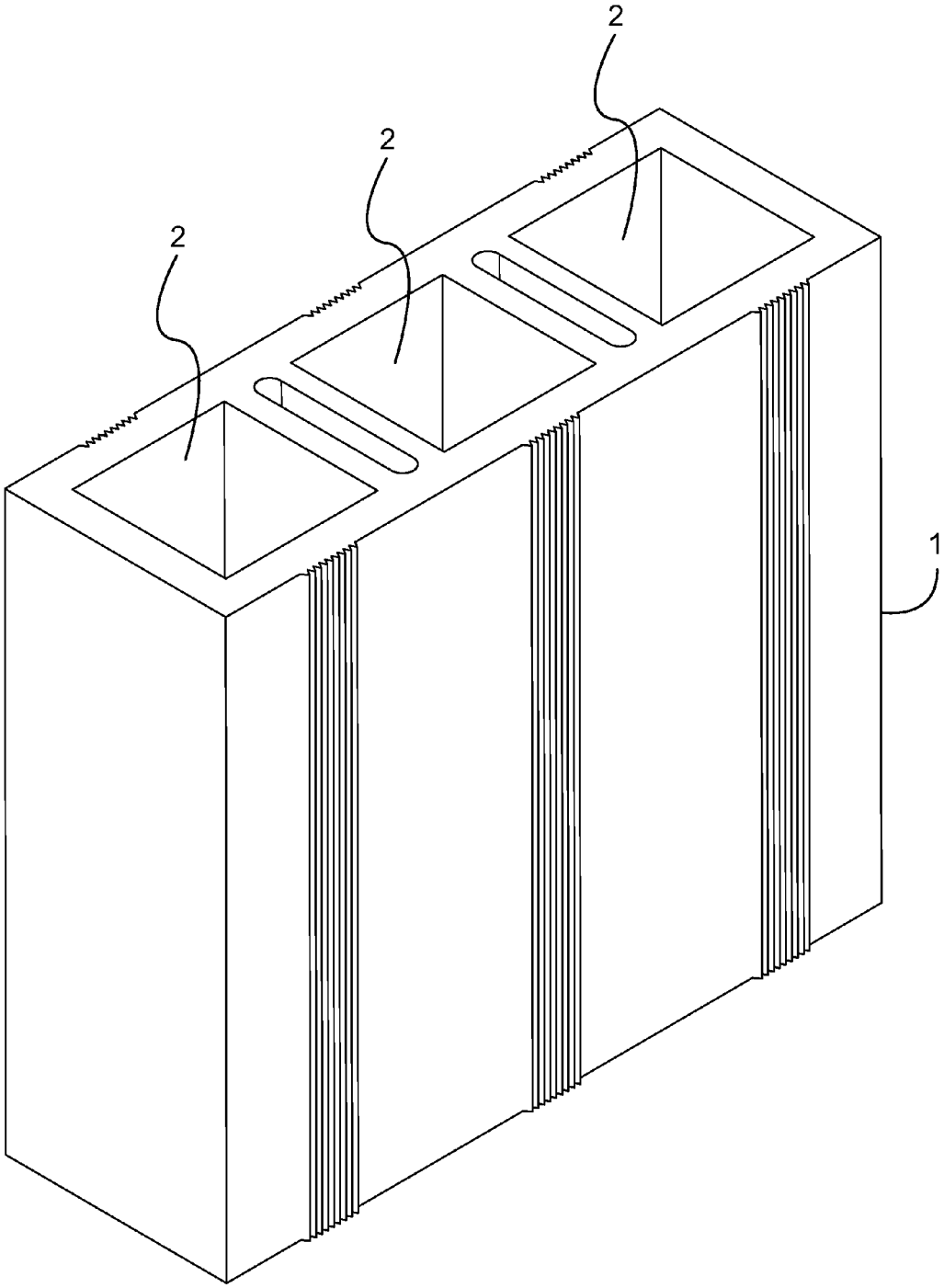
FIG. 1 is a perspective view of an embodiment of a clay block according to the invention.

The construction system of the invention consists of an original method in which the holes in the blocks are aligned exactly in a vertical direction. That is achieved by a special modular configuration for the blocks which can be of clay or concrete, both conventional primary materials. For joining the blocks we use a device that we call "connectors" to hold the blocks internally, providing great strength and sturdiness to the masonry, eliminating the use of mortar mix (cement and sand) between the blocks in the vertical as well as horizontal directions.

The construction system of the invention is characterized by the following:

a. VERTICALITY. Due to the fact that the system consists of assembling the blocks by means of the internal connectors, the verticality of the wall is maintained (plumb and square.) Therefore the construction of the walls is completed without having to use fillers to ensure verticality, resulting in a direct saving in masonry.

b. PATTERN DEVELOPMENT. Blocks were developed with special patterns which are produced industrially by means of specific machinery, nozzles and dies designed by the inventor.

c. EFFICIENCY. Consists of rationalizing construction, reducing costs, shortening delivery dates and eliminating waste.

d. DRY CONSTRUCTION TECHNIQUE. Assembly done by an internal fitting system, very simple, low cost and efficient e. CONNECTORS. The connector piece is made of recycled plastic material of high strength, which holds the blocks together internally.

f. APPEARANCE. Has an appearance similar to that of conventional masonry. The characteristic of this system of blocks and connectors is that they are the only unique and differentiated elements of the process, as the remaining components and their application are similar to conventional ones, except that their use is rationalized in terms of patterns and sizes.

The construction system of the invention presents the following advantages:

The construction system of the invention presents the following advantages:

Speed (50% faster)

Due to the fact that the construction is carried out in a toy building block-like manner, the walls are built quickly without having to wait for the mortar to set so that the external finish of the walls can be performed right after the assembly of the blocks.

Lower cost (30% cheaper) per meter

Since no mortar mix is used between blocks, the need for skilled labor is reduced (one assistant and one masonry apprentice) for the assembly. Furthermore are savings in materials for the mortar mix and its respective waste.

Elimination of the use of skilled labor in the erection of walls. Conventional masonry techniques are used only for the first row. Only one qualified bricklayer is needed for the leveling and laying of the first row. Computerized design of the work, flexibility in the modular design (three sizes of blocks). The design can dimension the walls with this system with elimination of waster, by using the three sizes of blocks, avoiding the need to split a block and discard the remainder.

Ease of expansion, addition and repair in civil construction sites. Can be performed very fast; construction of a wall can be extended in other directions by using the connectors, providing easy expansion without difficulty, reducing waste on the site while providing a solid and safe wall.

Clean worksite without debris

Except for the blocks and connectors, the rest of the components of the construction are conventional and available commercially.

A. Ceramic Blocks:

A strict and exact modular sizing has been established for the ceramic (clay) blocks.

Figure 2A:
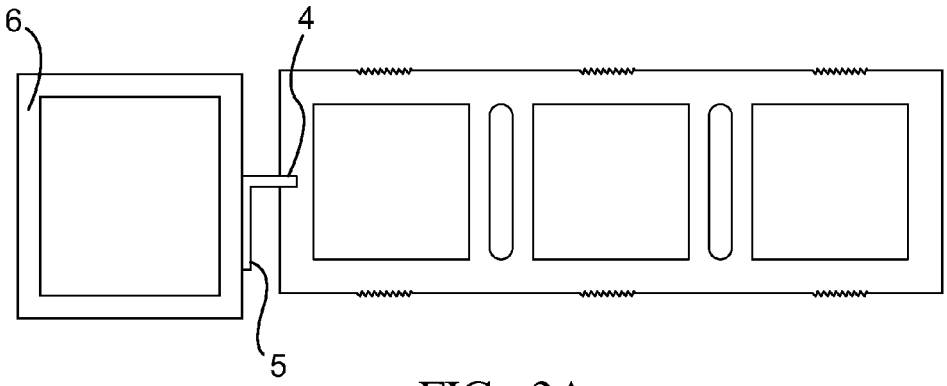
FIGS. 2A, 2B and 2C are plane and elevation views of an embodiment of a clay block according to the invention with a slot for anchoring to a steel structure.
Figure 2B:
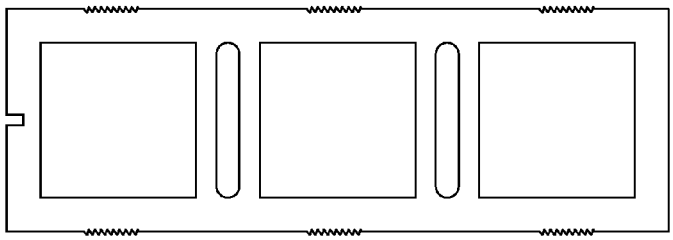
Figure 2C:
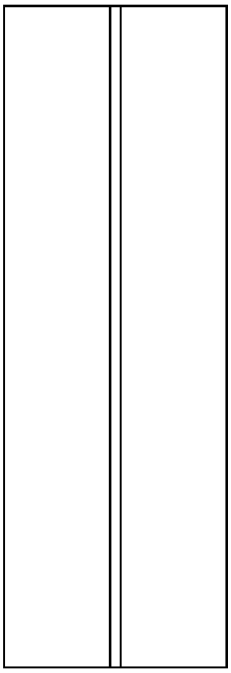

To streamline the construction three types of blocks are used, all of the same height, as shown in the following chart for clay blocks. An embodiment of such a block as shown in FIG. 1 has three holes (2). FIGS. 2A, 2B and 2C show an embodiment of a block provided with a slot (4) for anchoring the block to a steel structure (6) with a steel bracket (5).

TABLE FOR CLAY BLOCKS

| | | DIMENSIONS | | | | | |
|---|---|---|---|---|---|---|---|
| SERIES | TYPE BLOCK | E THICKNESS | H HEIGHT | L LENGTH | AREA ($M^2$) | VOLUME ($M^3$) | WEIGHT (KG) |
| A | A1 | 10 | 30.5 | 10 | 0.030 | 0.0013 | 1.560 |
| | A2 | | | 20 | 0.060 | 0.0026 | 3.120 |
| | A3 | | | 30 | 0.090 | 0.0044 | 5.280 |
| B | B1 | 12.5 | 30.5 | 12.5 | 0.038 | 0.0018 | 2.160 |
| | B2 | | | 25 | 0.075 | 0.0035 | 4.200 |
| | B3 | | | 37.5 | 0.113 | 0.0051 | 6.120 |
| C | C1 | 15 | 30.5 | 15 | 0.045 | 0.0023 | 2.760 |
| | C2 | | | 30 | 0.090 | 0.0044 | 5.280 |
| | C3 | | | 45 | 0.135 | 0.0064 | 7.680 |

Connectors

As the construction is a dry construction system, a connector has been designed for the fitting of one block with another. Two connectors are used per block. For each type of block a respective type of connector was created.

There are two types of connector for clay blocks: connector 1A and connector 2A.

Figure 3A:
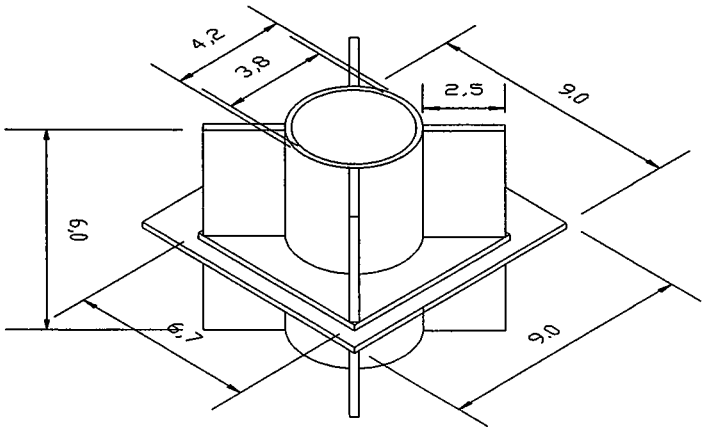
FIGS. 3A, 3B and 3C show respectively a perspective view, plane view and side elevation view of an embodiment of the connector 1A according to the invention.
Figure 3B:
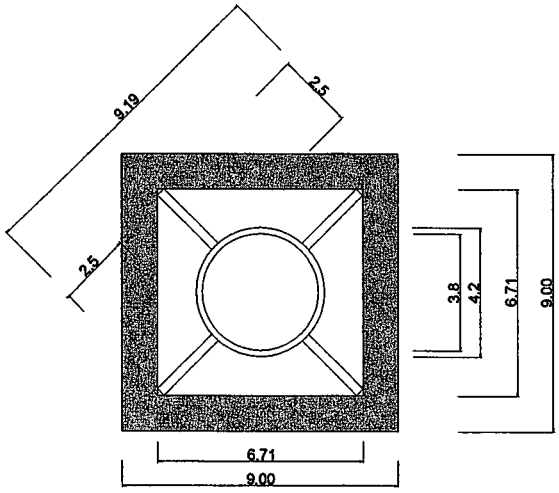
Figure 3C:
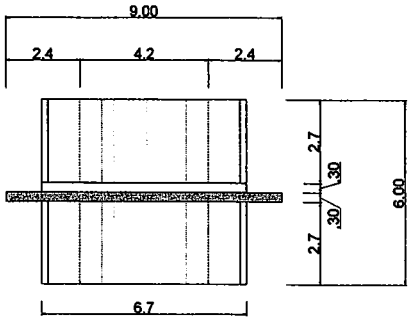

CONNECTOR 1A is shown in FIGS. 3A, 3B and 3C.

Figure 4A:
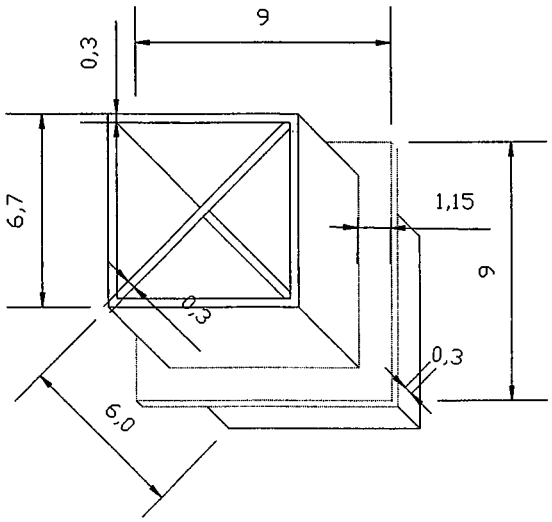
FIGS. 4A, 4B and 4C show respectively a perspective view, plane view and side elevation view of an embodiment of the connector 2A according to the invention.
Figure 4B:
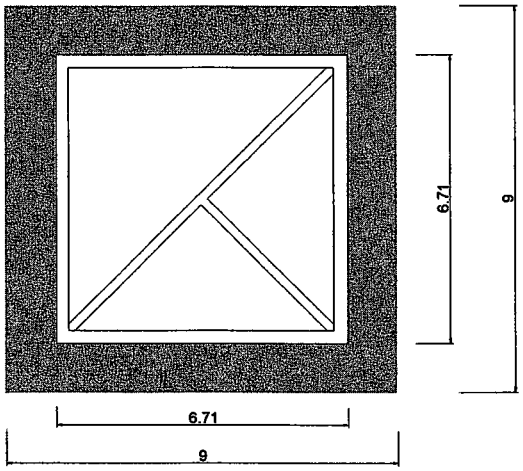
Figure 4C:
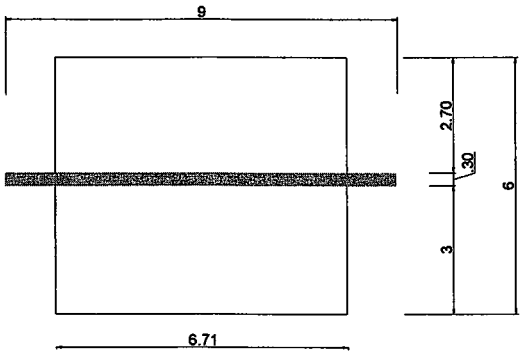
Figure 5:
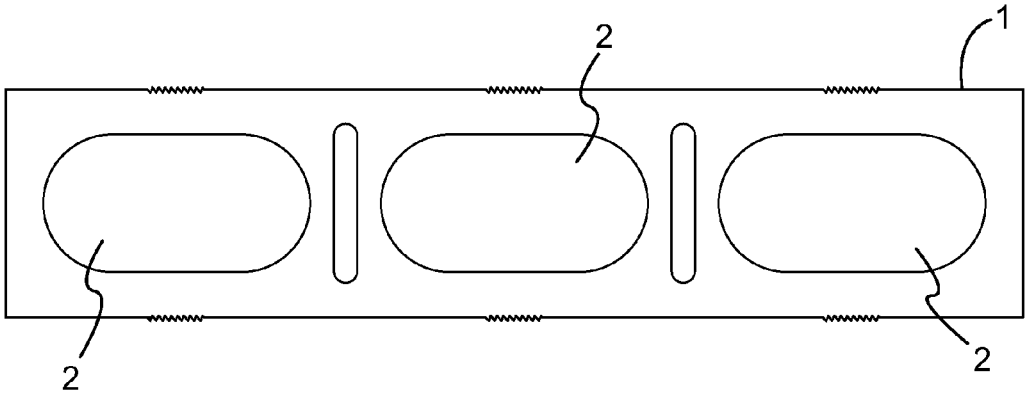
FIG. 5 shows a plane view of an embodiment of a concrete block according to the invention.
Figure 6A:
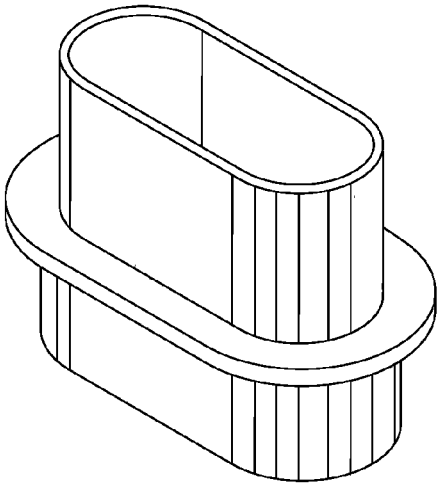
FIGS. 6A, 6B and 6C show respectively a perspective view, plane view and side elevation view of an embodiment of the connector C1 according to the invention.
Figure 6B:
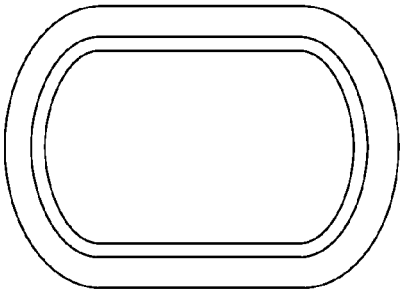
Figure 6C:
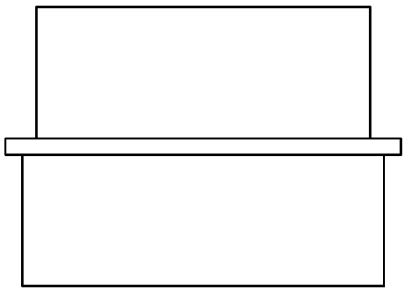

CONNECTOR 2A is shown in FIGS. 4A, 4B and 4C.

(For filling with concrete the holes in the block.)

The connectors are made of recycled plastic material having high strength.

The CONNECTOR 1A is used to fit one block with another. The CONNECTOR 2A is used when there is a need for more resistance and stability.

B. Concrete Blocks:

Just as with the ceramic blocks, the modular configuration is maintained in order to achieve continuity of the vertical holes. Rationalization is derived from the use of ⅓ blocks; ⅔ blocks and whole blocks. To streamline and reduce construction costs. See table below.

TABLE FOR CONCRETE BLOCKS

| SERIES | TYPE BLOCK | DIMENSIONS E THICKNESS | H HEIGHT | L LENGTH | AREA ($M^2$) | VOLUME ($M^3$) | WEIGHT (KG) |
|---|---|---|---|---|---|---|---|
| A | A1 | 10 | 21.5 | 10 | 0.0215 | 0.00138 | 3.036 |
| | A2 | | | 20 | 0.0430 | 0.00281 | 6.182 |
| | A3 | | | 30 | 0.0645 | 0.00413 | 9.086 |
| B | B1 | 12.5 | 21.5 | 12.5 | 0.0215 | 0.00269 | 3.982 |
| | B2 | | | 25 | 0.0430 | 0.00538 | 8.118 |
| | B3 | | | 37.5 | 0.0645 | 0.00806 | 11.058 |
| C | C1 | 15 | 21.5 | 15 | 0.0215 | 0.00323 | 4.928 |
| | C2 | | | 30 | 0.0430 | 0.00645 | 9.878 |
| | C3 | | | 45 | 0.0645 | 0.00968 | 14.044 |

The connectors are of the same size and shape as the holes in the blocks. The connector is at one end of the same size as the upper portion of the hole, and at the other end has the dimension of the lower portion of the hole, the holes in the block being slightly conical. In the middle of the connector is a horizontal plate which separates the two connected blocks in a uniform manner.

Depending on the building needs the following are provided:

B.1. 10 cm×45 cm Blocks 10 cm blocks. Having conventionally a length of 45 cm. With three oval shaped holes. Said holes are of trapezoidal shape to facilitate unmolding during the manufacture of the blocks.

Connectors C1.

The connectors for the 10 cm concrete blocks have two dimensions because of the configuration of the holes in the block, since those holes are slightly trapezoidal.

B.2. 15 cm×45 cm Blocks

Figure 7:
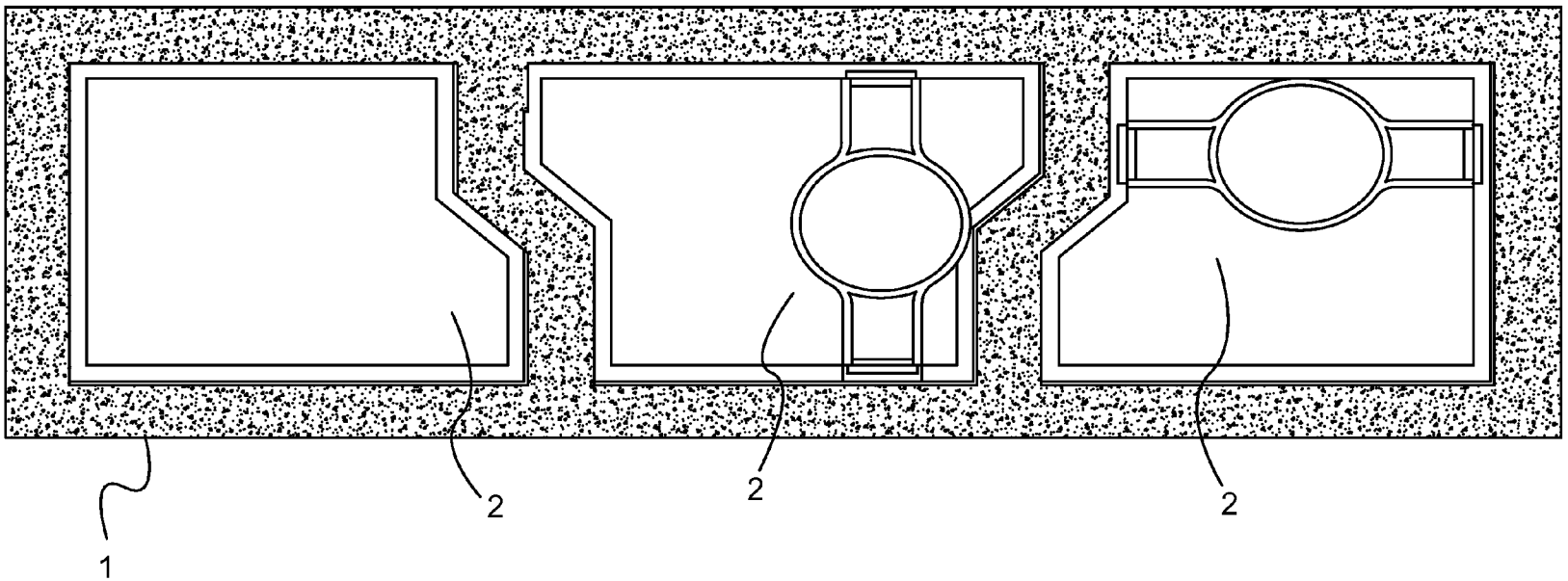
FIG. 7 shows a plane view of an embodiment of a thicker block and connectors according to the invention.

To meet the needs in different stages of the construction, a block of large thickness, as shown in FIG. 7, has been designed as required for thicker walls, e.g. bathrooms.

Figure 8A:
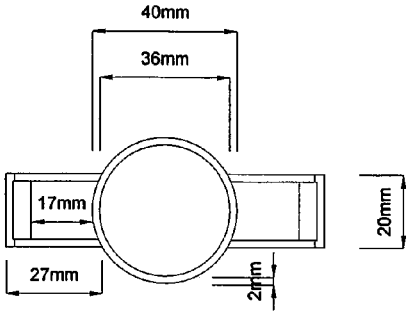
FIGS. 8A, 8B and 8C show respectively a plane view, elevation view and lateral view of an embodiment of a connector C2 according to the invention.
Figure 8B:
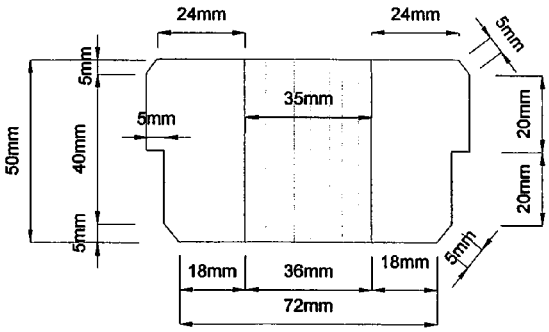
Figure 8C:
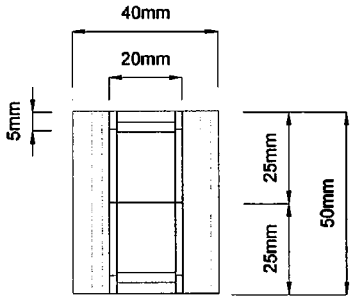

Connectors C2:

The connectors for 15 cm concrete blocks were designed in a manner that they can be used in both directions in the holes of the blocks, to provide better stability to the wall and maintain the fitting in two dimensions due to the configuration of the hole of the block, the holes being slightly trapezoidal. These connectors are illustrated in FIGS. 8A, 8B and 8C.

Figure 9A:
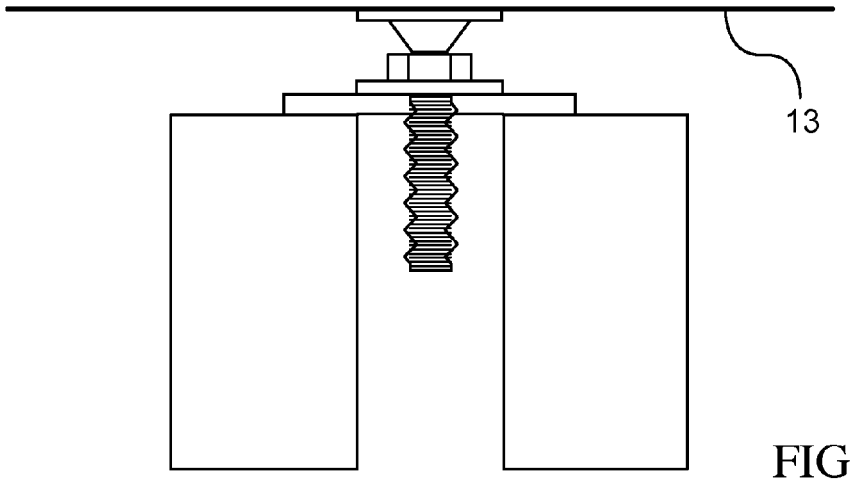
FIGS. 9A, 9B and 9C are schematic side view illustration of the fastening of the blocks in the top row by means of an extensor according to the invention.
Figure 9B:
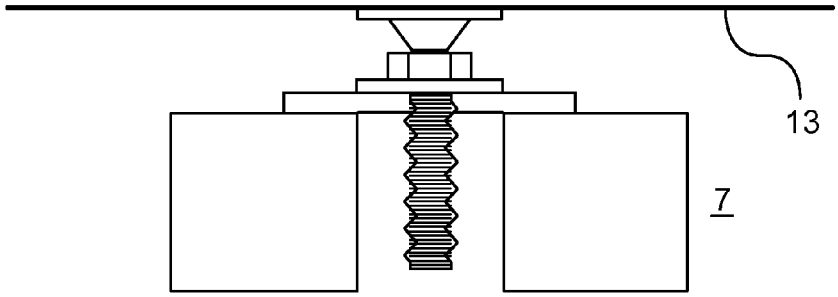
Figure 9C:
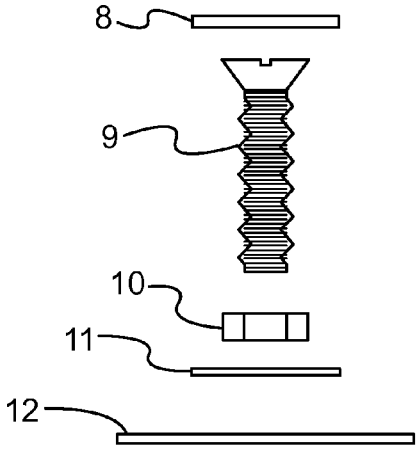
Figure 10C:
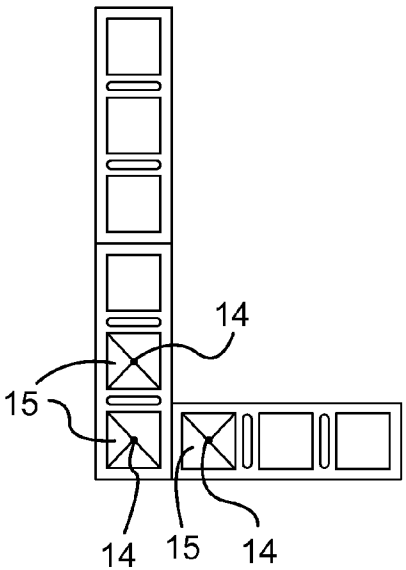
FIGS. 10A, 10B and 10C are schematic plane views of mortar-filled reinforcing columns at the corner and adjacent to the corner in T-shaped, +-shaped and L-shaped intersections of walls.
Figure 10B:
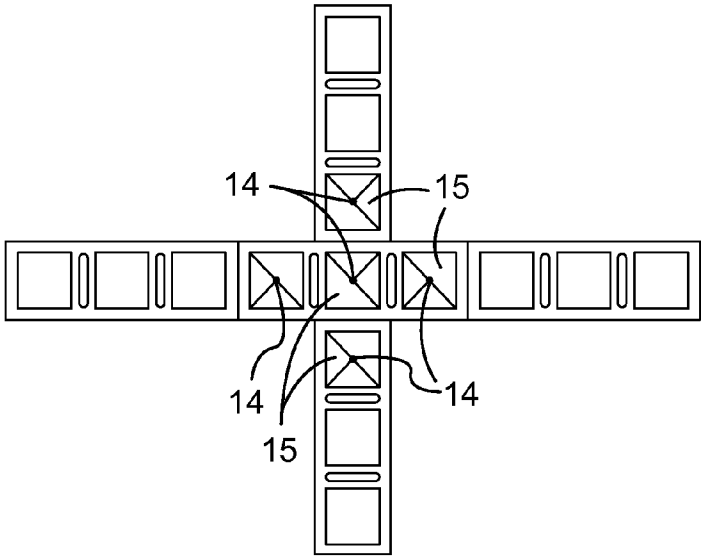
Figure 10A:
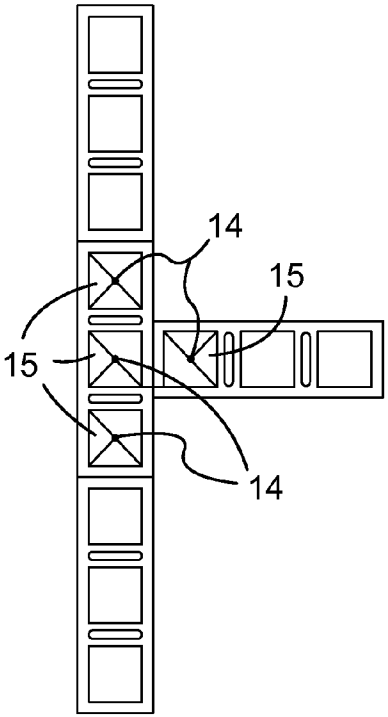
Figure 11A:
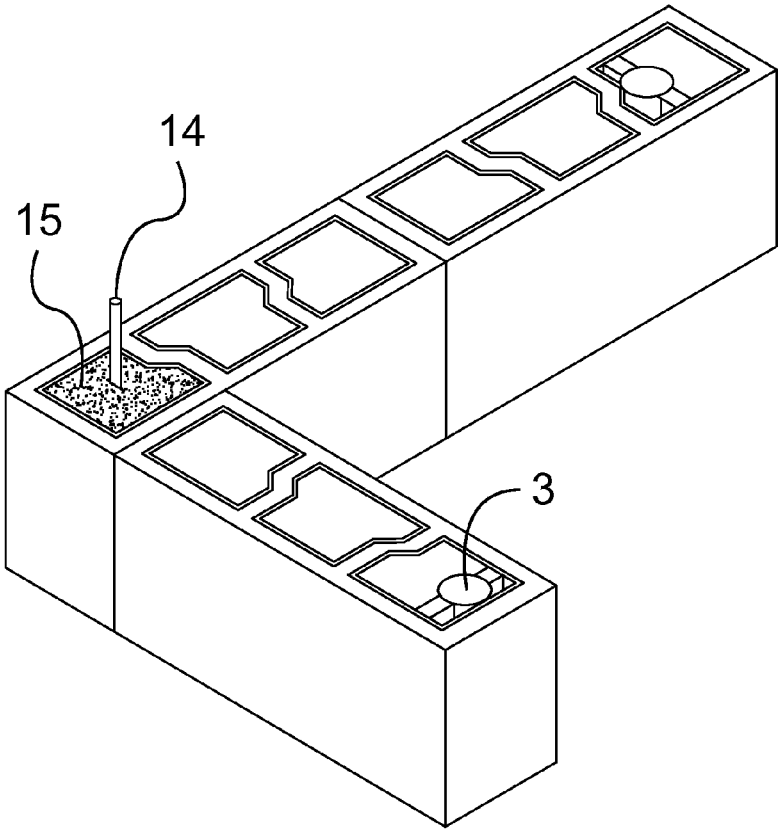
FIGS. 11A, 11B and 11C are respectively perspective views of L-shaped, T-shaped and +-shaped intersecting walls reinforced at the corner with concrete filling around a steel bar.
Figure 11B:
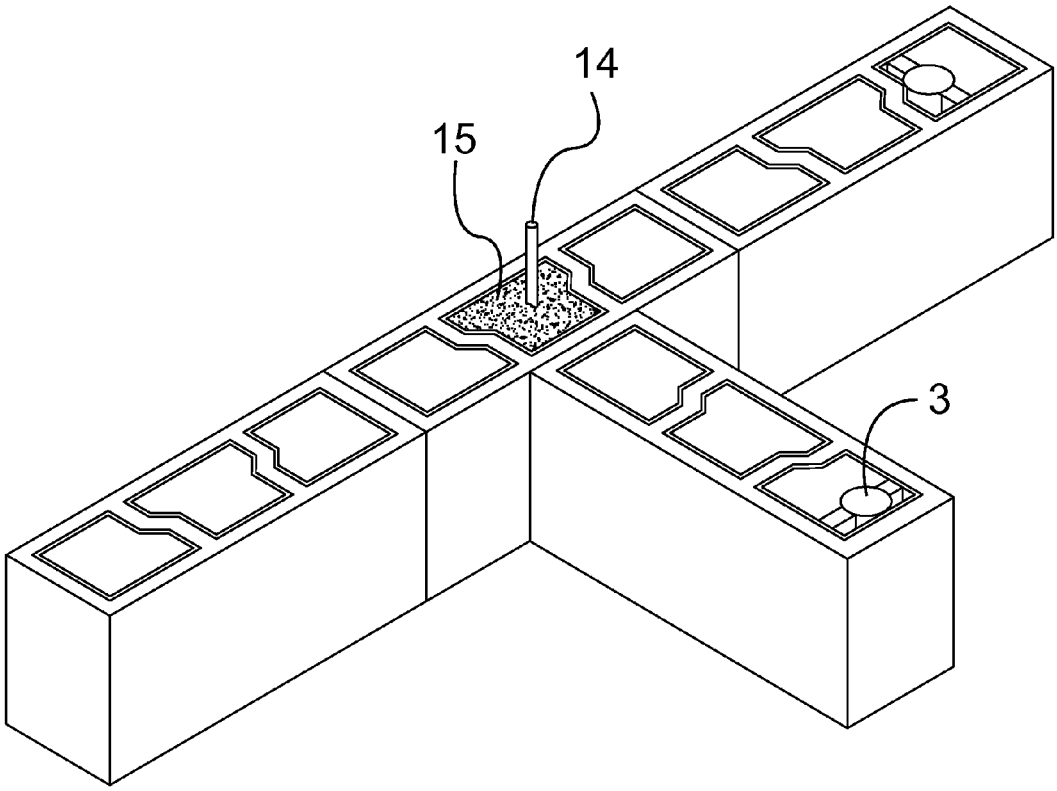
Figure 11C:
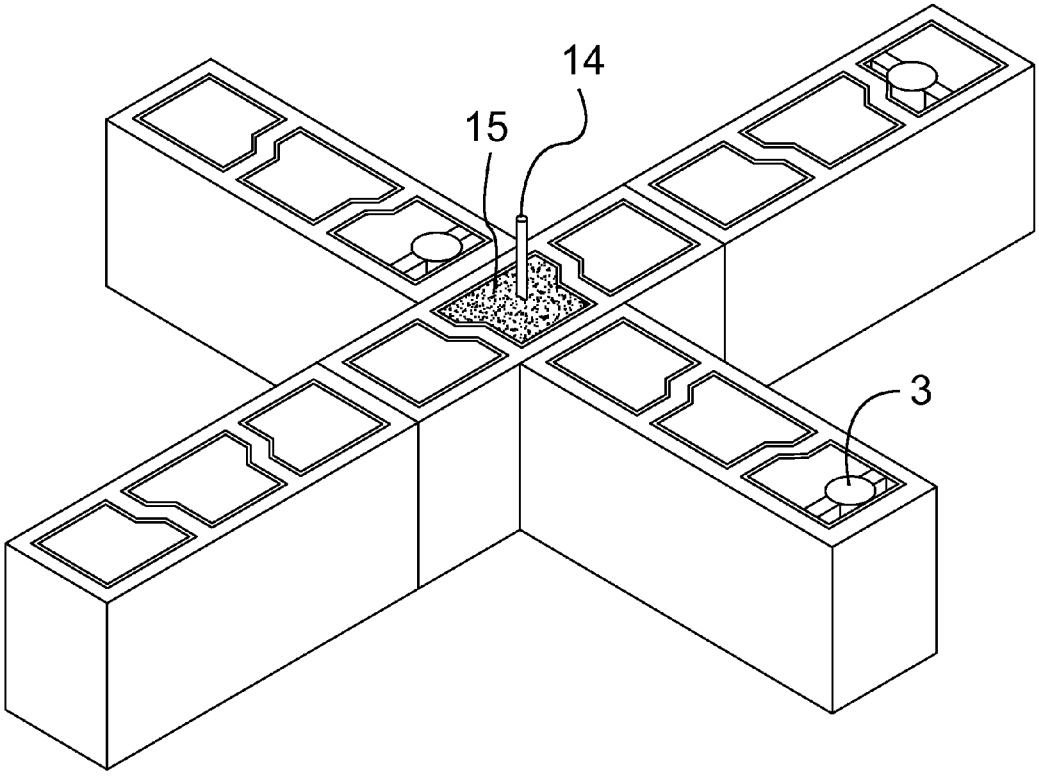
Figure 11D:
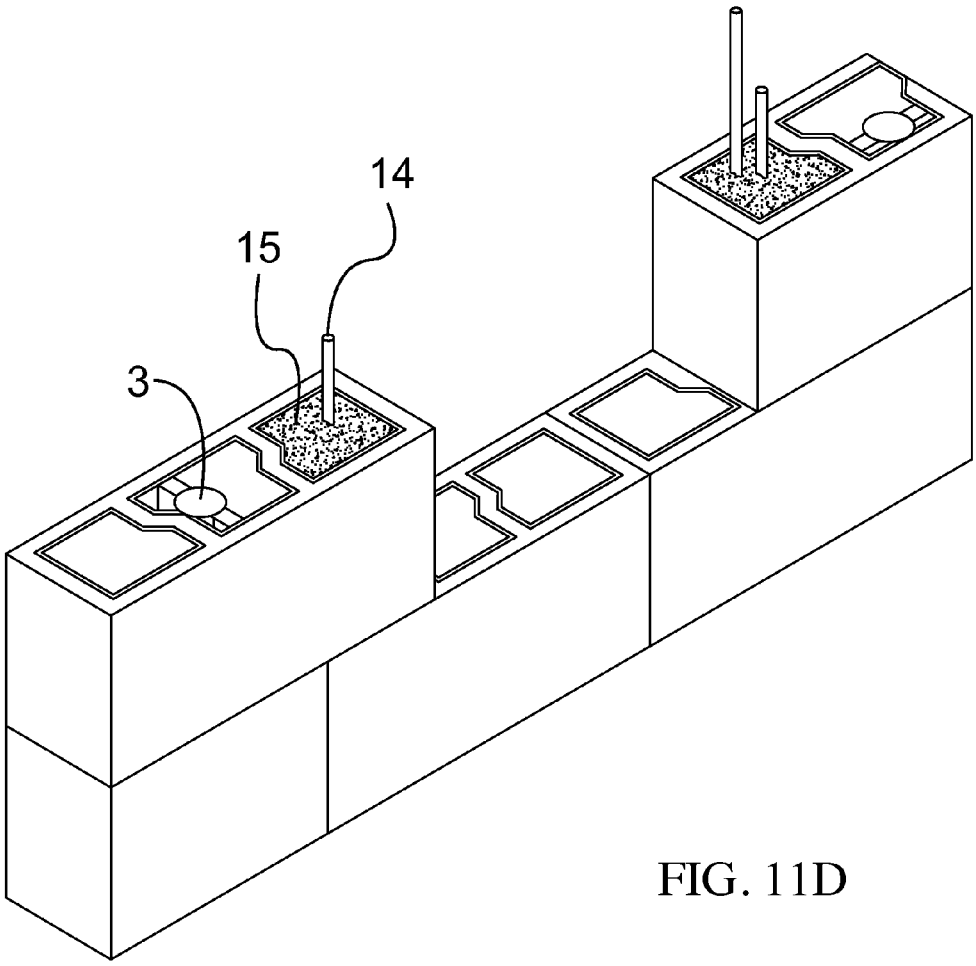
FIGS. 11D and 11E are respectively perspective views of holes reinforced with concrete filling around a steel bar adjacent to a window opening or at the edge of a free-standing wall.
Figure 11E:
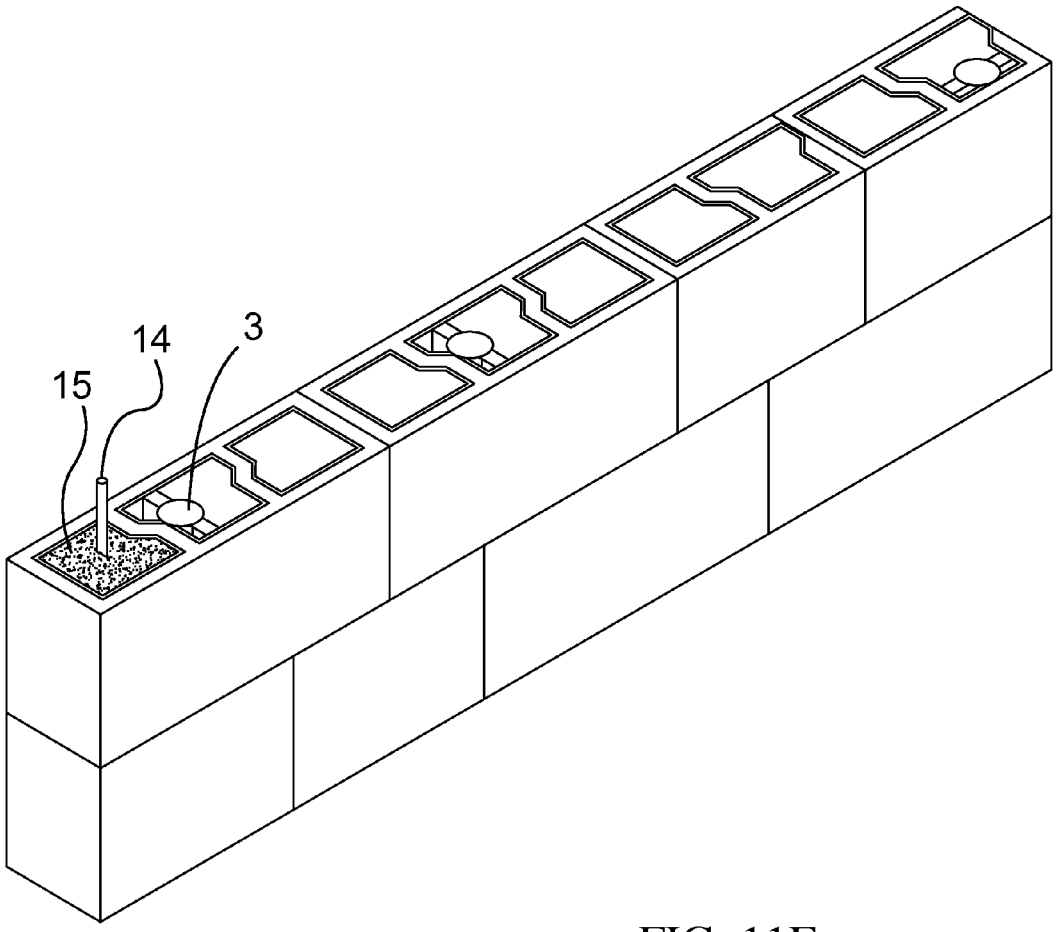
Figure 12A:
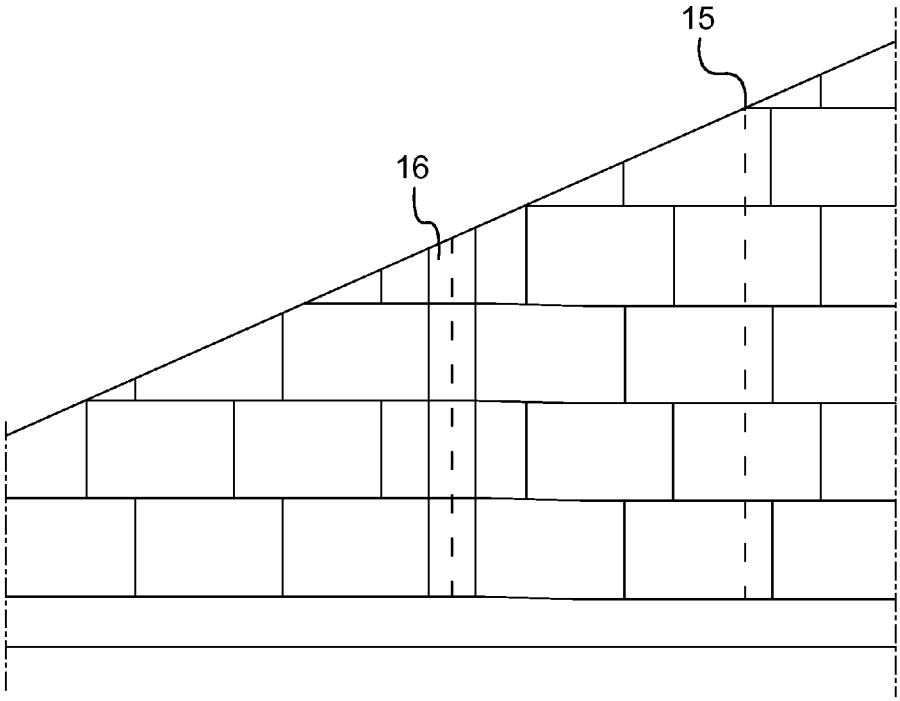
FIGS. 12A, 12B and 12C show respectively a front view, a plane view and another front view of an inclined wall reinforced with a mortar filled column and a reinforcing abutment.
Figure 12B:
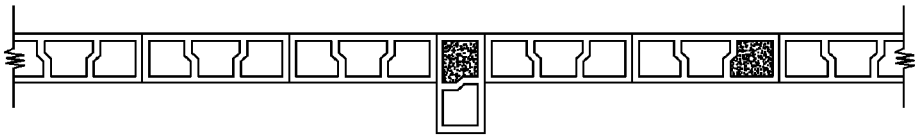
Figure 12C:
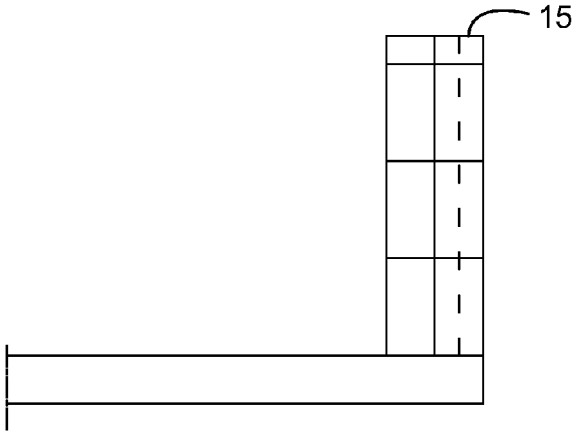

With the construction system of the invention, the process starts after having the floor or slab for the construction. To proceed, follow the sequence of steps described below:

1. The first row is placed on mortar or a traditional mix and checked to be plumb and square, the subsequent blocks are positioned by means of the connectors, using two connectors per block, preferably in the outermost holes.
2. Doors and windows are dimensioned in a modular format. For example, the opening for a door should end in row number 7 or a multiple of 30 cm. Proceed with the same format for windows.
3. When reaching the final row, a piece called "EXTENSOR" is used to fix the wall to the tie beam or existing slab. See FIGS. 9A, 9B and 9C showing an extensor (7) between a block at the top of the wall and the lower face (13) of a slab or beam. A NEOPRENE rubber plate (8) is pressed against the lower face (13) by a screw (9) provided with a nut (10) and a washer (11). A flat bar of galvanized steel (12) is placed between the block at the top of the wall and the screw/nut/washer assembly.
4. Tie columns: To increase resistance and stability small columns are created by filling the holes in the block with 1:3:3 concrete and ⅜" steel Embodiments of such columns formed by inserting a steel bar (14) in a hole and filling the hole with concrete (15) are shown in FIGS. 10A, 10B, and 10C, and FIGS. 11A, 11B and 11C.
   a. Applied in cases such as: wall intersections in shape of L, T and +. The corners and the first hole in each direction are filled.
   b. The holes adjacent to windows and doors openings are filled in the same manner.
   c. In free standing walls, i.e., which do not intersect, the last hole is filled in the same manner.
   d. When the walls have long stretches, more than 2 meters, the holes are reinforced at every meter.
   e. An inclined wall as seen in FIGS. 12A, 12B and 12C may have a column filled with concrete (15) as well as an abutment (16) filled with concrete.

Figure 13:
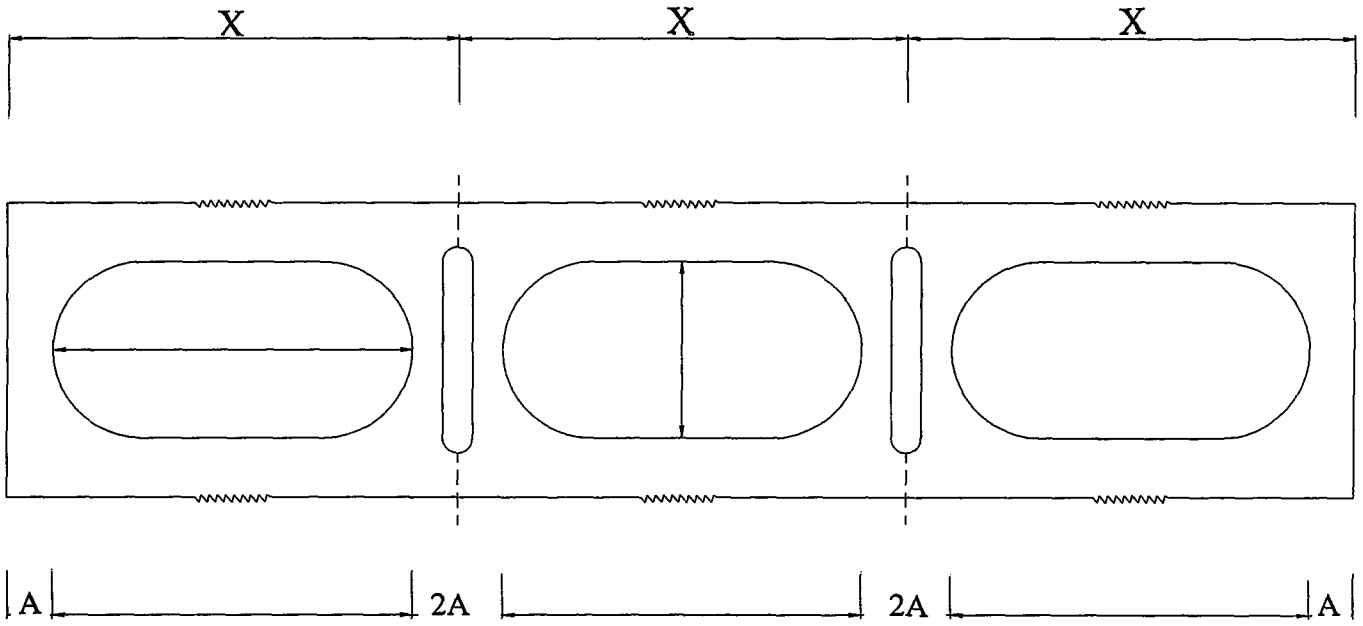
FIG. 13 is a plane view showing the required dimensions for a whole block according to the invention.
Figure 14:
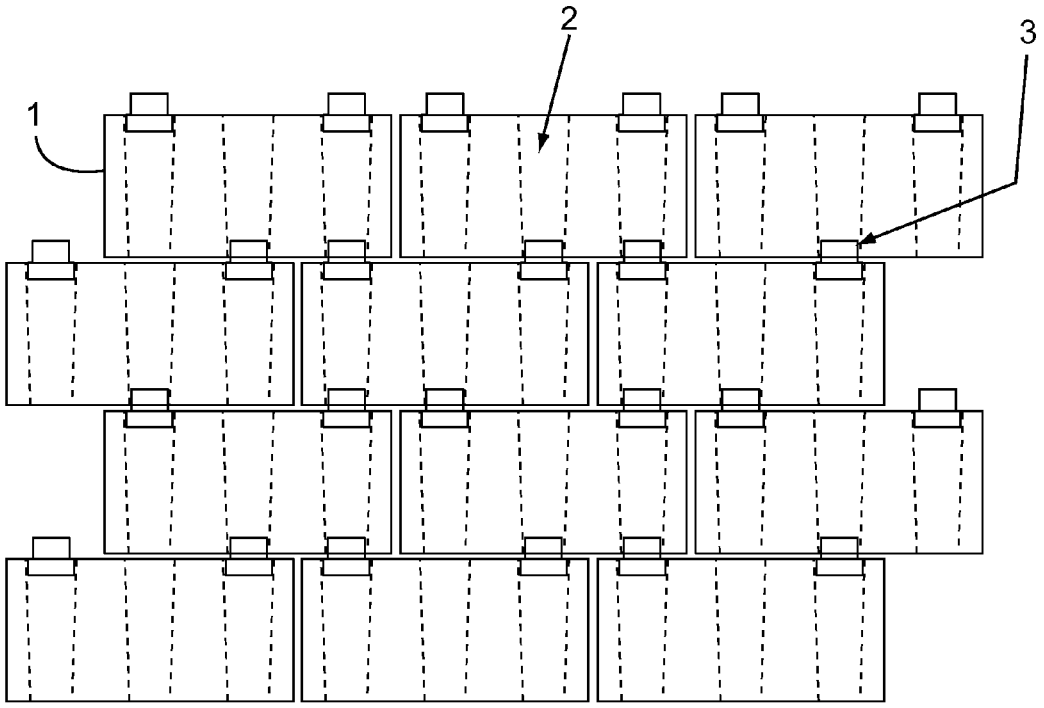
FIG. 14 shows schematically an embodiment of a wall built with the blocks and connectors according to the invention.

In preferred embodiments of the system of the invention, the blocks are characterized by the dimensions represented by the distance (2A) at the center being twice the distance (A) at the end of a block, i.e., equal parts from center to center of each section of the block. This exact and repetitive modular configuration ensures continuity of the holes in a vertical succession of holes from one layer to another. An example of these dimensions is shown in FIG. 13, which illustrates that the distance X should be the same in all the sections of the blocks. This principle also applies to blocks with different sizes and numbers of cells or holes, and for holes with different shapes but of equal dimensions. By following this modular configuration the holes or cells are held in vertical continuity, as illustrated in FIG. 14.

As we have described the invention consists of two basic and indispensable elements for fulfilling the purpose of the invention, one being the blocks to be correctly set in modular fashion, and the other being the connectors which are fitted in the holes of the blocks. One advantageous aspect of the system of the invention is that no mortar is needed for fixing one block to another, either in the vertical or horizontal direction. Another novel aspect is that, since the assembly is a dry technique, it is not necessary to wait for the setting or hardening of the mortar so that the wall can be completed by proceeding immediately to the step of applying an outer finishing layer to the wall.

The invention claimed is:

1. A building structure comprising at least one wall formed from a plurality of concrete modular building blocks and a plurality of monolithic, hollow connectors, the plurality of concrete modular building blocks comprising:

a first plurality of blocks having a rectangular prismatic shape defined by a thickness T, a height H, and a length 3L;

a second plurality of blocks having a rectangular prismatic shape defined by a thickness T, a height H, and a length 2L;

a third plurality of blocks having a rectangular prismatic shape defined by a thickness T, a height H, and a length L;

wherein the first, second, and third plurality of blocks are used to form the at least one wall having at least one desired profile of a vertical edge for the building structure;

each of the plurality of building blocks having a top face, a bottom face, a front face, a rear face, and two end faces connecting the front and rear face, each of the of the plurality of building blocks further having at least one hole extending from the top face to the bottom face, wherein the first plurality of blocks having three holes, the second plurality of blocks having two holes, and the third plurality of blocks having one hole, each of the holes equally spaced within each section of block delimited by the value L, each of the holes being the same size and further having a slightly conical shape and having an oval shaped horizontal cross-section along the length;

the plurality of connectors are formed from high impact recycled plastic material and have an oval shaped upper portion, an oval shaped lower portion, and a horizontal plate extending around the periphery of the connector at a midway between an upper end and a lower end of the connector forming the upper portion and the lower portion, wherein the horizontal plate, in use, separates two of the plurality of building blocks connected by one of the plurality of connectors in a uniform manner, each of the plurality of connectors is formed with the oval shaped upper portion and the oval shaped lower portion having two different dimensions such that the oval shaped upper portion of each connector has a size and shape similar to that of a lower end of one of the at least one hole and the oval shaped lower portion of each connector has a size and shape similar to that of an upper end of one of the at least one hole due to the slightly conical shape of each of the at least one hole;

the at least one wall of the building structure further comprising:

a first row formed from the plurality of building blocks aligned along the length in which an end face of one of the plurality of building blocks abuts with an end face of another one of the plurality of building blocks forming a first junction between adjacent blocks within the first row, the plurality of building blocks in the first row being affixed to a floor surface with a cement-based mix;

a second row formed from the plurality of building blocks laid on top of the first row in which an end face of one of the plurality of building blocks abuts with an end face of another one of the plurality of building blocks forming a second junction between adjacent blocks within the second row, the plurality of building blocks of the second row being offset with the plurality of building blocks of the first row such that each of the second junctions are not aligned with first junctions;

the at least one wall further comprising subsequent rows formed in the same manner as the first row, wherein the subsequent rows are offset from the row below such that the junctions between adjacent ones of the plurality of building blocks are not aligned;

wherein each of the first, second, and subsequent rows are formed using a combination of blocks from the first, the second, and the third plurality of blocks to create the at least one wall of the building structure having the at least one desired profile of the vertical edge, the at least one desired profile being a straight vertical edge;

each of the plurality of building blocks are held in place by at least one of the plurality of connectors without the use of a cement-based mix being applied between rows of the plurality of building blocks, wherein the upper portion of one of the plurality of connectors is inserted into one of the holes of a building block of an upper row and the lower portion of the one of the plurality of connectors is inserted into one of the holes of a building block of a lower row abutting the upper row, wherein each of the upper faces of the first plurality of building blocks being fitted with two connectors within two holes which engage holes of two different building blocks of an adjacent upper row;

each of the at least one hole of the plurality of building blocks of the first, second, and subsequent rows being aligned forming a vertical succession of communicating holes, wherein only some of the holes in vertical succession being fitted with one of the plurality of connectors;

wherein the at least one wall of the building structure further comprises one or more reinforcing columns provided at one or more selected positions within the at least one wall, the one or more reinforcing columns formed by fitting one of the vertical successions with a steel rod and filling the remaining space around the steel rod with a cement-based mix, wherein at least one of the vertical successions of the building structure is not one of the selected positions and is without a steel rod and without a cement-based mix; and wherein one of the subsequent rows includes a top row formed from the plurality of building blocks, the top row being secured to a beam or slab located above the top row by an extensor, the beam or slab having a lower face, and the extensor comprising:

a rubber plate;

a screw having a vertical length, the screw is threaded through a nut and a washer; and a flat steel bar provided atop the top row, wherein the screw bears against the flat steel bar by rotating the nut along the vertical length of the screw thereby pressing the rubber plate against the lower face of the beam or slab to fix the at least one wall to the building structure.

2. A building structure according to claim 1, wherein the one or more reinforcing columns is at an end of the at least one wall.

3. A building structure according to claim 1, wherein the one or more reinforcing columns are repeated at intervals along the at least one wall.

4. A building structure according to claim 1, wherein the one or more reinforcing columns is at a corner formed between the at least one wall and an adjacent one or more walls.

5. A building structure according to claim 1, which comprises a square or rectangular opening for a door or window, the opening being formed by using a combination of the first, the second, and the third plurality of blocks.

6. A building structure according to claim 5, in which a vertical series of communicating holes nearest one side of the opening is fitted with a steel rod and filled with concrete to form a reinforcing column for the one side of the opening.

* * * * *